US008146565B2

(12) United States Patent
Leone et al.

(10) Patent No.: US 8,146,565 B2
(45) Date of Patent: Apr. 3, 2012

(54) REDUCING NOISE, VIBRATION, AND HARSHNESS IN A VARIABLE DISPLACEMENT ENGINE

(75) Inventors: Thomas G. Leone, Ypsilanti, MI (US); Donald J. Lewis, Howell, MI (US); Husein Sukaria, Dearborn, MI (US); Eric Tseng, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 694 days.

(21) Appl. No.: 12/173,271

(22) Filed: Jul. 15, 2008

(65) Prior Publication Data

US 2010/0012072 A1 Jan. 21, 2010

(51) Int. Cl.
*F02D 1/00* (2006.01)

(52) U.S. Cl. ..... 123/319; 123/481; 123/198 F; 123/334

(58) Field of Classification Search ..... 123/481, 123/198 F, 319, 320, 325, 326, 329, 332, 123/334; 701/110–112, 1, 29, 34, 70, 123
See application file for complete search history.

(56) References Cited

U.S. PATENT DOCUMENTS 5,374,224 A * 12/1994 Huffmaster et al. ..... 477/181
5,431,139 A * 7/1995 Grutter et al. ..... 123/198 F
5,762,366 A 6/1998 Faye
6,247,449 B1 6/2001 Persson
6,808,471 B1 * 10/2004 Bauerle et al. ..... 477/107
6,886,649 B2 * 5/2005 Wakashiro et al. ..... 180/65.26
6,988,481 B2 1/2006 Sen et al.
7,104,244 B2 9/2006 Nishi et al.
7,184,879 B1 * 2/2007 Lewis ..... 701/112
7,203,579 B2 4/2007 Yokota et al.
7,426,915 B2 * 9/2008 Gibson et al. ..... 123/198 F
2002/0112902 A1 * 8/2002 Wakashiro et al. ..... 180/65.2
2007/0235005 A1 * 10/2007 Lewis ..... 123/322

OTHER PUBLICATIONS

Falkowski, A. et al., "Design and Development of the DaimlerChrysler 5.7L HEMI® Engine Multi-Displacement Cylinder Deactivation System", SAE Technical Papers, No. 2004-01-2106, Warrendale, Pennsylvania, Copyright © 2004 SAE International.

Leone, T.G. et al., "Fuel Economy Benefit of Cylinder Deactivation—Sensitivity to Vehicle Application and Operating Constraints", SAE Technical Papers, No. 2001-01-3591, International Fall Fuels and Lubricants Meeting and Exposition, San Antonio, Texas, Sep. 24-27, 2001, Copyright © 2001 Society of Automotive Engineers, Inc.

* cited by examiner

*Primary Examiner* — John Kwon
(74) *Attorney, Agent, or Firm* — Allan J. Lippa; Alleman Hall McCoy Russell & Tuttle LLP

(57) ABSTRACT

A method for operating an engine of a vehicle, the engine having one or more deactivatable cylinders, the method including controlling the stability of a vehicle in response to vehicle acceleration, and reactivating or deactivating combustion in at least a cylinder in response to vehicle acceleration.

15 Claims, 5 Drawing Sheets

REDUCING NOISE, VIBRATION, AND HARSHNESS IN A VARIABLE DISPLACEMENT ENGINE

BACKGROUND/SUMMARY

Engines operating with a variable number of active or deactivated cylinders may be used to increase fuel economy, while optionally maintaining the overall exhaust mixture's air-fuel ratio about stoichiometry via cylinder valve deactivation. Engines capable of deactivating a plurality of cylinders are commonly referred to as Variable Displacement Engines (VDE). Deactivating a cylinder may include disabling fuel injection and/or valve actuation in the cylinder. In some examples, half of an engine's cylinders may be deactivated during selected conditions. The selected conditions can be defined by parameters such as speed/load window, as well as various other operating conditions including vehicle speed. Increasing the time during which the vehicle operates with deactivated cylinders can increase the fuel economy of the vehicle.

However, in some engine/vehicle combinations utilizing variable displacement, only modest fuel economy gains are achieved. Various factors may limit the potential fuel economy gain, such as noise, vibration, and harshness (NVH) constraints. These factors may serve to reduce the available window of VDE operation, thus reducing potential gains. While various approaches of the skilled engine designer are aimed at reducing these limitations via enhanced design, fuel economy gains may nevertheless be difficult to realize in practice. In particular, the engine may be calibrated for worst case NVH conditions, thereby decreasing the available window for VDE operation.

In U.S. Pat. No. 7,104,244 an attempt is made to reduce NVH in a VDE during operation of a partial-cylinder mode. A time interval, identified as the "degree of continuation" parameter, is initiated when the torque produced by the engine exceeds a threshold value. If the degree of continuation increases above a threshold value, the partial-cylinder mode of operation is discontinued, due to a high probability that the vehicle is experiencing NVH.

The inventors herein have recognized several issues with the above approach. U.S. Pat. No. 7,104,244 utilizes a mode map to determine when the number of cylinders in operation should be adjusted. As noted above, such maps may be calibrated for worst case scenarios. For example, under certain conditions the vehicle may not experience NVH when it is being operated above a threshold torque, which may lead to unnecessary activation of a number of cylinders in the engine, further decreasing the fuel economy.

The above issues may be addressed by a method for operating an engine of a vehicle, the engine having one or more deactivatable cylinders, the method comprising: controlling the stability of a vehicle in response to vehicle acceleration; and reactivating or deactivating combustion in at least a cylinder in response to vehicle acceleration.

For example, the vehicle acceleration (e.g., lateral acceleration, yaw, etc.) can be used to not only improve stability of the vehicle; but also, for detecting engine vibration. Since the engine is coupled to the vehicle chassis, engine vibration can cause the vehicle chassis to exhibit acceleration. In particular, the engine firing-frequency component of the vehicle acceleration can be used to identify undesirable engine vibration. In turn, sensed engine vibration or acceleration can be used to appropriately control cylinder reactivation. In this way, it may be possible to better correlate NVH conditions and effects of partial cylinder operation. As a result, it is possible to improve vehicle fuel economy because the engine can be operated with fewer cylinders over extended operating conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

A vehicle system is described having an engine with cylinder deactivation and electronic vehicle stability control, where an acceleration sensor provides information used to both activate/deactivate cylinders of the engine and control the vehicle to maintain stability during various maneuvers. For example, yaw sensor information may be used in automatic control of one or more vehicle brakes to reduce a roll tendency of the vehicle during turning conditions. Additionally, the sensor information (after being processed through a band-pass filter) may also be used to identify engine vibration during cylinder deactivation conditions. Based on these identified conditions, the engine may be controlled to reactivate one or more cylinders to thereby mitigate the sensed vibration. In this way, a common acceleration sensor may be used to improve two separate applications. Further, sensor information may be used to inhibit deactivation of one or more cylinders if the engine is operating rougher than expected during selected engine operating conditions.

Figure 1:
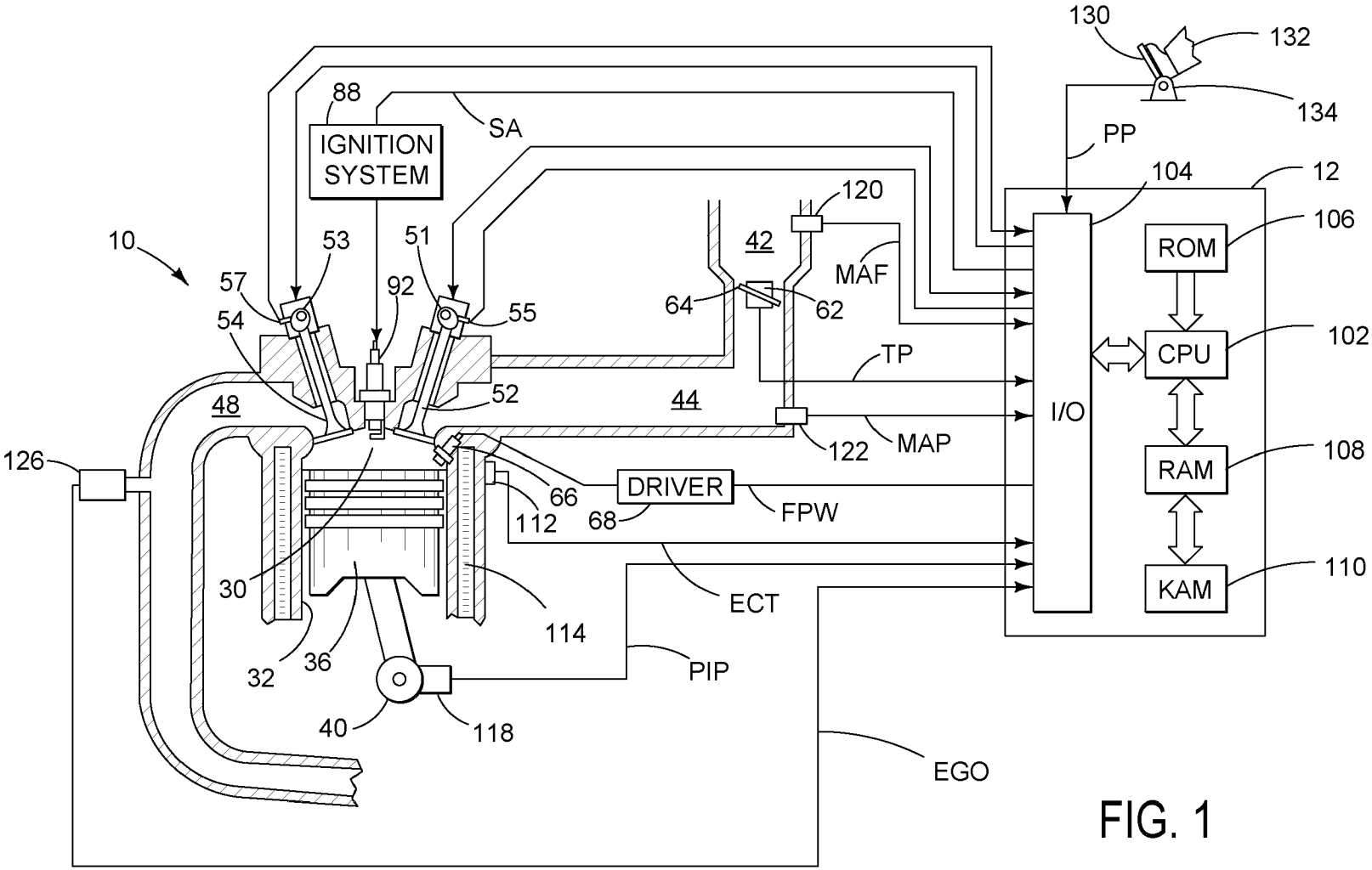
FIG. 1 shows a schematic depiction of one cylinder in the internal combustion engine.

Referring now to FIG. 1, it shows a schematic diagram showing one cylinder of multi-cylinder engine 10, which may be included in a propulsion system of a vehicle. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems. Additionally, the intake and exhaust valves of one or more cylinders of the engine, such as cylinder 30, may include a valve deactivation mechanism for deactivating the intake and/or exhaust valves such that the valve(s) is(are) held closed during the engine cycle. In this way the piston compresses and expands the same gasses repeatedly. In one example, the cylinders are deactivated to trap burnt combustion gasses.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel delivery system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

As described above, FIG. 1 shows only one cylinder of a multi-cylinder engine, and that each cylinder may similarly include its own set of intake/exhaust valves, fuel injector, spark plug, etc.

Storage medium read-only memory 106 can be programmed with computer readable data representing instructions executable by processor 102 for performing the methods described below as well as other variants that are anticipated but not specifically listed.

Figure 2:
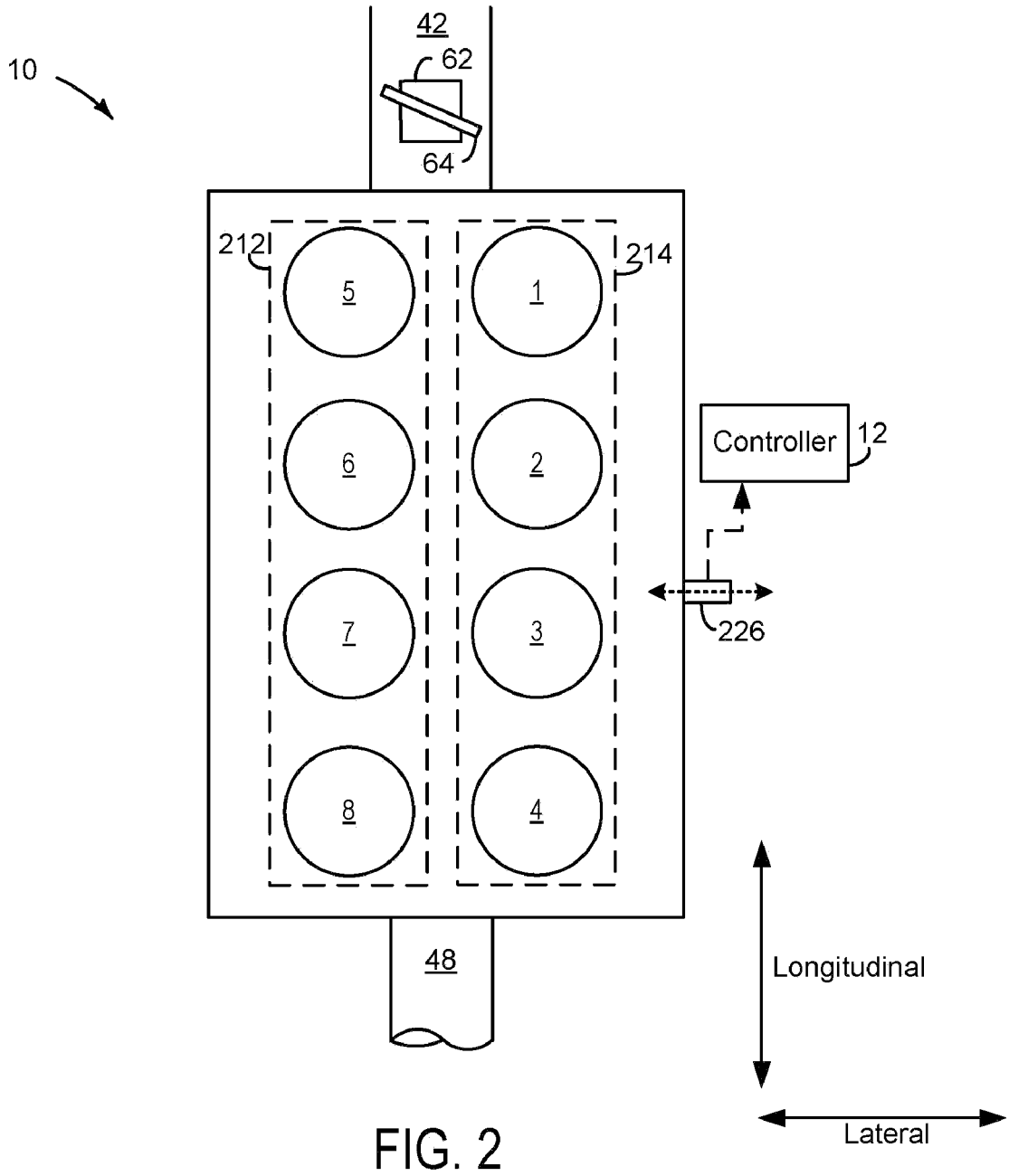
FIG. 2 shows a schematic depiction of an engine with a plurality of cylinders.

FIG. 2 shows an exemplary configuration of engine 10. In particular, a V-8 engine is illustrated with a left cylinder bank 212 and a right cylinder bank 214. The left cylinder bank may include a fifth cylinder, a sixth cylinder, a seventh cylinder, and an eighth cylinder. The right cylinder bank may include a first cylinder, a second cylinder, a third cylinder, and a fourth cylinder. The engine may further include an intake passage 42, with a throttle plate 64 and throttle 62, and an exhaust manifold 48. One or more catalysts and air-fuel ratio sensors may be located in the exhaust manifold. For example, the exhaust system may include light-off catalysts and underbody catalysts, as well as exhaust manifold, upstream and/or downstream air-fuel ratio sensors.

Additionally, an acceleration sensor 226 may be coupled to the engine and electronically coupled to controller 12. In this example, the acceleration sensor is an engine lateral acceleration sensor. However, in other examples the acceleration sensor may be configured to measure various acceleration components of the engine and/or the vehicle, such as a longitudinal acceleration, yaw sensor, etc. Under some conditions the controller may be configured to activate one or more cylinders in response to the acceleration sensor, discussed in more detail herein with regard to FIGS. 3-6. Yet in other examples, a plurality of acceleration sensors may be coupled to the engine and/or to the vehicle, and controller 12 may activate and/or deactivate cylinders in response to the plurality of acceleration sensors. While FIG. 2 shows a V-8 configuration, various other configurations may be used, if desired.

In the example of FIG. 2, engine 10 is a Variable Displacement Engine, in which a number of cylinders may be deactivated. Deactivation may include disabling fuel injection to the cylinder and/or holding the cylinder intake and exhaust valves closed, and trapping exhaust gas in the combustion chamber, during one or more engine cycles. Furthermore, cylinder deactivation may include deactivating the cylinder valves (e.g. intake valve and exhaust valve) via hydraulically actuated lifters coupled to valve pushrods, or via a cam profile switching mechanism in which a cam lobe with no lift is used for deactivated valves. In this way, the cylinders are deactivatable. Still other cylinder deactivation mechanisms may also be used, such as electrically actuated valves, disabled fuel injection with normal valve operation, etc.

The engine may be configured to operate in a first mode where all the cylinders carry out combustion, and in a second mode where one or more of the cylinders in the engine are deactivated. The second mode may be referred to as a partial-cylinder mode of operation or VDE mode. In one example, the first, fourth, sixth, and seventh cylinders may be deactivated in the partial-cylinder mode of operation. In other examples, additional or alternate cylinders may be deactivated. Various methods for controlling activation and deactivation of cylinders based on vehicle acceleration are described further herein, such as in FIG. 6.

Figure 3:
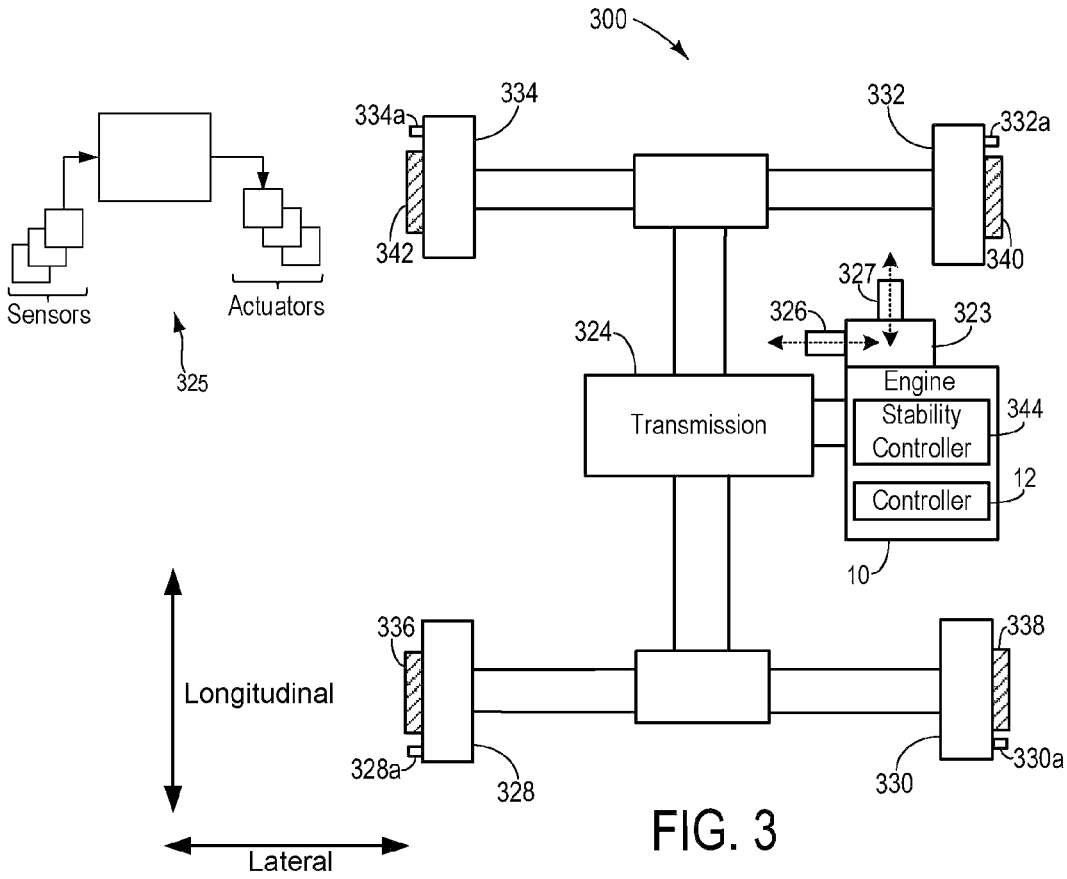
FIG. 3 shows a schematic representation of a vehicle including an engine, transmission, and associated systems.

FIG. 3 shows a schematic depiction of a transmission 324 and a control system 325 in a vehicle 300. The control system may include an Electronic Stability Control (ESC) system and/or a Roll Stability Control (RSC) system, discussed in more detail herein.

Engine 10 may be operably coupled to transmission 324. The transmission may have a plurality of selectable gears, allowing the power generated by the engine to be transferred to the wheels. In another example, the transmission may be a Continuously Variable Transmission (CVT), capable of changing steplessly through an infinite number of gear ratios. In other examples, still other transmissions may be used which are capable of transferring power generated by the engine to the wheels, such as an automatic or manual transmission.

A lateral acceleration sensor 326 may be coupled to the vehicle's body 323. The lateral acceleration sensor is configured to measure the lateral acceleration of the vehicle. Additionally, a longitudinal acceleration sensor 327 may be coupled to the vehicle's body. The longitudinal acceleration sensor is configured to measure the longitudinal acceleration of the vehicle. In other examples, the acceleration sensor may be coupled to another suitable location and/or a plurality of acceleration sensors may be coupled to other suitable locations in the vehicle such as the transmission and/or engine, capable of measuring a variety of acceleration components of the vehicle. Furthermore, the transmission may be operably coupled to two or four wheels of the vehicle, (328, 330, 332, and/or 334).

Further, in some examples when an engine is mounted longitudinally, a lateral acceleration sensor may be used, such as sensor 326. However, when an engine is mounted laterally (i.e. transversely), such as in most front wheel drive applications, a longitudinal acceleration sensor may be used, such as sensor 327. In this way the acceleration sensor may be mounted substantially perpendicular to the direction in which the engine is mounted.

Wheel speed sensors 328*a*, 330*a*, 332*a*, and 334*a*, may be coupled to each of the vehicle's wheels 328, 330, 332, and 334, respectively. The wheel speed sensors are configured to measure the rotational speed of each individual wheel. A vehicle stability controller 344 may be electronically coupled to the wheel speed sensors, 328*a*, 330*a*, 332*a*, and 334*a*, as well as the lateral acceleration sensor 326 and longitudinal acceleration sensor 327. In some examples, vehicle stability controller may be included in engine controller 12. In other examples vehicle stability controller 344 and engine controller 12 may be separate controllers.

Continuing with FIG. 3, wheel brake mechanisms 336, 338, 340, and 342 are coupled to each wheel, 328, 330, 332, and 334, respectively. The wheel brake mechanisms may be actuated via electronic signals from stability controller 344. In this example, the wheel brake mechanisms include actuators (not shown), pads (not shown), rotors (not shown), etc. In other examples, other suitable wheel braking mechanisms may be utilized.

The ESC system adjusts vehicle actuators to maintain the vehicle on the driver's intended course. Various components may be associated with the ESC system. The components may include, but are not limited to, stability controller 344, various acceleration sensors, Hall effect sensor 118, the throttle position sensor, and various other components. The ESC system may measure various vehicle operating conditions, and further determine the intended course and the actual course of the vehicle. In response to a disparity between the intended course and actual course, the ESC system may actuate various mechanisms in the vehicle, allowing the vehicle to maintain the intended course. The mechanisms may include brake actuators of an associated braking system, the throttle, as well as the fuel delivery system, and combinations thereof.

In one specific example, the actual vehicle motion may be measured via a lateral acceleration, yaw, and/or wheel speed measurement. The intended course may be measured by a steering angle sensor. Further, the ESC system may take actions to correct under-steer or over-steer.

Alternatively, even when the vehicle is following a desired course, the ESC may take corrective action to increase the vehicle's stability. For example, the RSC system may determine if one or more wheels of the vehicle may lose contact with the road due to an increase in lateral acceleration. If so, the RSC system may brake one or more wheels and/or decrease the power produced by the engine or delivered to the wheels. The RSC system may include stability controller 344 and a lateral acceleration sensor.

Control system 325 may include wheel brake mechanisms 336, 338, 340, and 342, engine controller 12, shown in FIG. 1 and FIG. 2, acceleration sensors 226, 326, and 327 shown in FIG. 2 and FIG. 3, as well as various other components shown in FIG. 1-FIG. 3. In one example, control system 325 may include engine controller 12 and stability controller 344, one or both communicating with acceleration sensor(s) and passing the signal over the Computer Area Network CAN.

Figure 4:
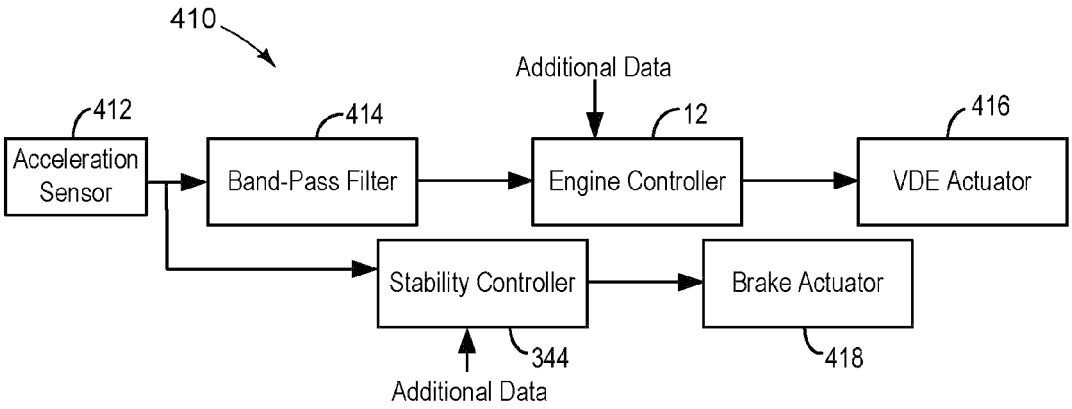
FIG. 4 shows an exemplary control system which may be used to perform stability control and VDE activation or deactivation.

FIG. 4 shows an exemplary control system 410 which may be used to activate or deactivate a VDE mode in the engine as well as perform stability control. An acceleration sensor 412 may be used by two or more controllers, allowing the cost and complexity of the vehicle to be reduced. In particular an acceleration sensor may be electronically coupled to a filter 414 and stability controller 344, discussed above. In this example the filter is a band-pass filter. In other examples another suitable filter may be used to remove unwanted frequencies. Furthermore, the filter may be electronically coupled to engine controller 12. Additional data may be directed to both the engine controller and the stability controller. The engine controller, in conjunction with other components, may control VDE actuation (e.g., activate or deactivate one or more cylinders) via a VDE actuator 416. The VDE actuator may include various components capable of activating or deactivating the cylinders such as cam actuation systems 51 and 53 and/or fuel injector 66. Furthermore, the stability controller may be coupled to a brake actuator 418. As discussed above, a wheel braking mechanism may be actuated via an actuator in response to an acceleration signal produced by the acceleration sensor. In this way the acceleration sensor may be utilized by multiple controllers.

Figure 5:
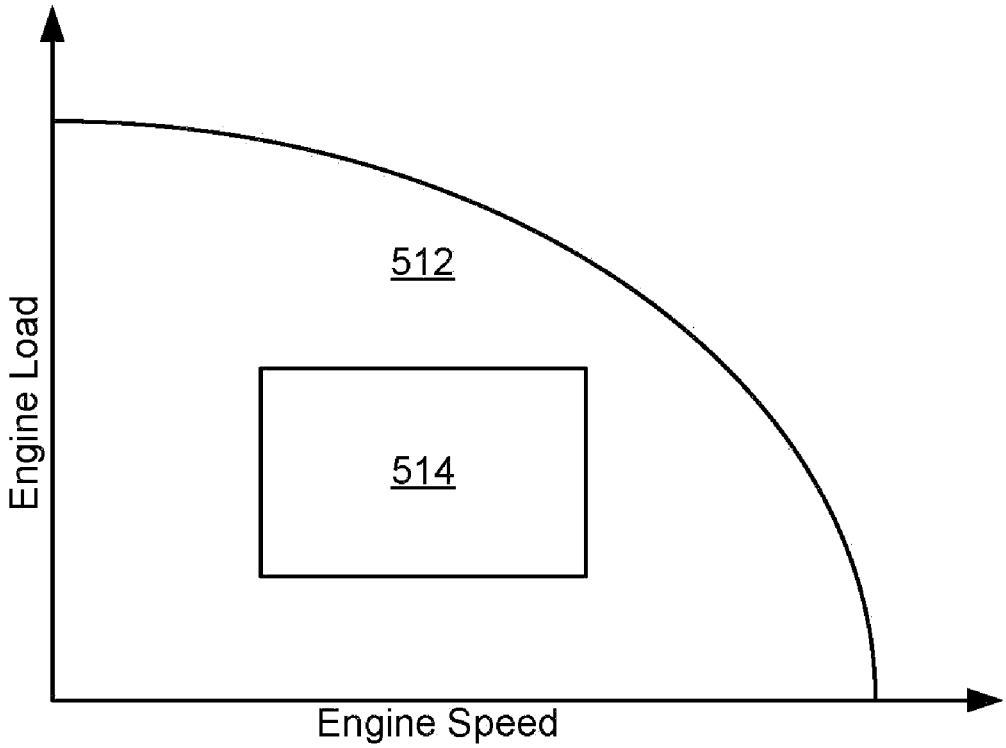
FIG. 5 shows a mode map for an example engine control strategy.

Controller 12 may utilize a mode map, shown in FIG. 5, to select the engine cylinder operating mode. The engine speed RPM is on the x-axis and the engine load is on the y-axis. In particular, the mode map may be used to select a first mode of operation 512 and a second mode of operation 514. The first mode of operation may include an operating state where all of the cylinders in the engine carry out combustion. The second mode of operation may include an operating state in which one or more of the cylinders in the engine are deactivated. In some examples the second mode of operation may be referred to as a partial cylinder window of operation or a VDE window. In an alternate example, another suitable mode map may be used to determine the mode of operation of the engine.

Figure 6:
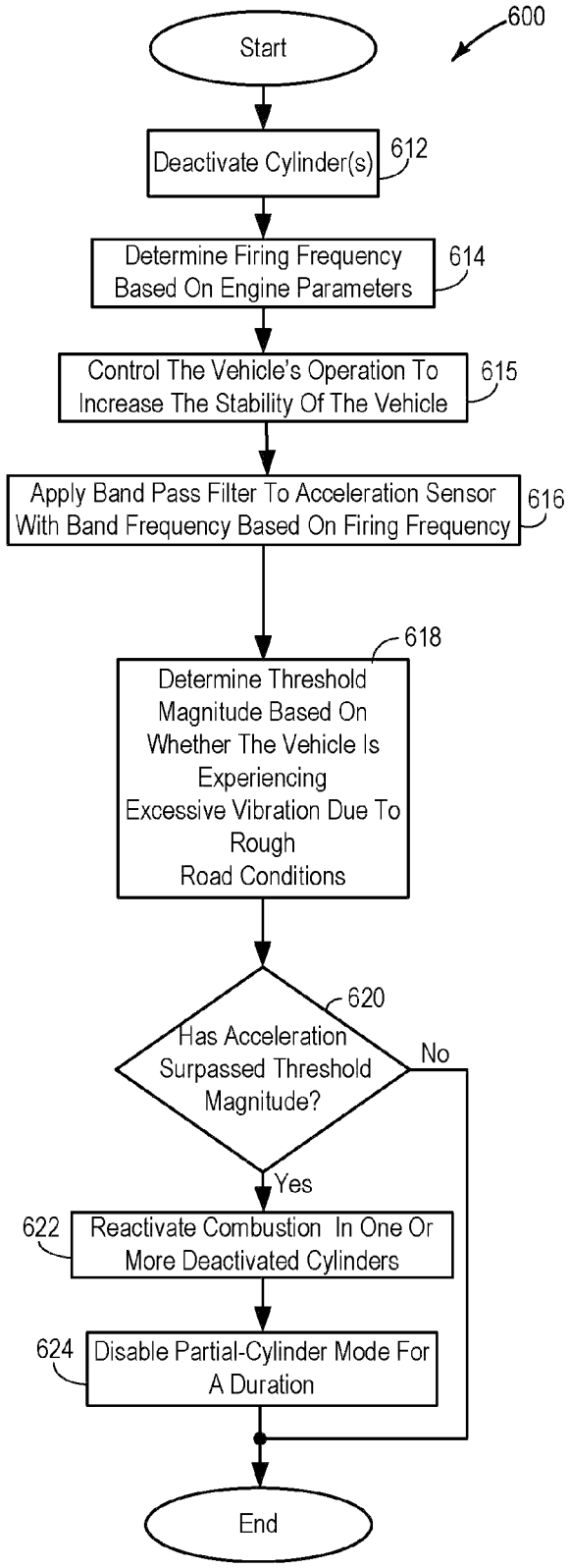
FIG. 6 shows a method that may be implemented to control vehicle stability and reduce NVH in the vehicle using a vehicle acceleration sensor.

FIG. 6 shows a method 600 that may be implemented to control vehicle stability and the engine cylinder deactivation mode in response to a vehicle acceleration determined by one or more vehicle acceleration sensors. Method 600 may be implemented via the components and systems described above, but alternatively may be implemented using other suitable components. In some examples, method 600 may be implemented subsequent to crank and prior to engine shut down. Furthermore, method 600 may increase the VDE window of operation, shown in FIG. 5. In this way the fuel economy of the vehicle may be improved.

At 612, one or more cylinders are deactivated in the engine based on engine operating conditions, such as based on the mode map of FIG. 5. Deactivating the cylinders may include: discontinuing fuel injection into the cylinders, and/or seating and sealing all of the intake and exhaust valves associated with the deactivated cylinder(s), and/or prohibiting fuel from being injected into the combustion chamber.

The method then proceeds to 614, where the firing frequency in the engine is determined based on various engine parameters which may include engine speed, number of activated cylinders, etc.

The method then proceeds to 615 where a signal produced by the acceleration sensor(s) associated with the ESC system is used to control the vehicle's operation, increasing the stability of the vehicle. In this example, the wheel brake mechanisms are selectively actuated in response to one or more of a longitudinal sensor, yaw sensor, and/or lateral acceleration sensor to maintain vehicle stability. Additionally, engine torque may be reduced in response to the vehicle acceleration to increase the vehicle stability.

Figure 7:
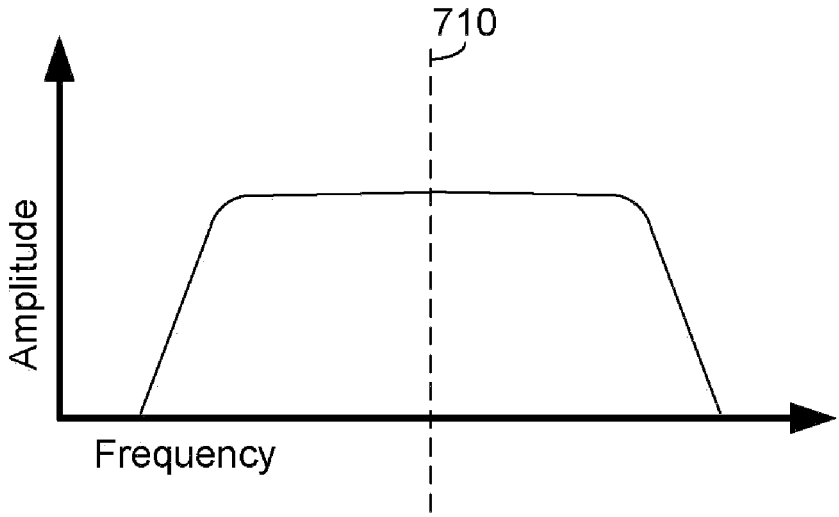
FIG. 7 illustrates an example filter that may be applied to a signal measured by the acceleration sensors shown in FIG. 2 and/or FIG. 3.

The method then proceeds to 616, where a digital or analog filter is applied to the signal produced by the acceleration sensor associated with the ESC. In one example, the filter is a band-pass filter, where the band is based on the firing frequency of the engine cylinders carrying out combustion. For example, the frequency band is lowered during the partial-cylinder mode as compared to full cylinder operation, at a given engine speed. The filter may be applied to eliminate unwanted frequencies (e.g. noise) which may be generated by bumps in the road, oscillatory motion of the suspension, etc. As illustrated in FIG. 7, the band-pass filter may selectively filter frequencies outside a window around band frequency 710.

Despite the filtering, the signal to noise ratio may still be substantial. A significant source of noise in the acceleration sensor signal may be generated from travel over rough roads. Rough road conditions may include conditions during which the road surface has uneven grading. For example, a road may have a washboard surface causing the vehicle to experience excessive vibration. Wheel speed sensors may be used to detect if the vehicle is experiencing rough road conditions. Consequently, after 616 the method may proceed to 618, where a threshold magnitude is determined based on whether the vehicle is experiencing excessive vibration due to rough road conditions. At least one wheel speed sensor may be used to make the aforementioned determination. If the vehicle is experiencing excessive vibration due to rough road conditions, a higher threshold magnitude is used. For example, the threshold may be determined based on the level of road roughness. In one particular example, the threshold is increased proportionally to the degree of road roughness.

At 620, it is determined if the filtered acceleration measured by the acceleration sensor has surpassed the threshold magnitude. If the acceleration measured by the acceleration sensor has not surpassed a threshold magnitude the method ends. However, if the acceleration at or about the engine firing frequency (as indicated by the band-pass filtered acceleration sensor) has surpassed a threshold magnitude, the method advances to 622.

At 622, combustion is reactivated in one or more of the deactivated cylinders. Reactivation of combustion may include operating the intake and exhaust valves, delivering fuel to the combustion chamber, delivering a spark to the combustion chamber, etc. Next, the method advances to 624 where the partial-cylinder mode may be disabled for a duration, such as for a predetermined period of time. The partial-cylinder mode may be disabled for a predetermined period of time to reduce excessive entering and exiting of the partial-cylinder mode. In some examples, the predetermined period of time may be two minutes. Yet in other examples, the VDE may be disabled until one or more engine shut-downs and re-starts have been performed.

In this way, the control system, via feedback from one or more of the acceleration sensors, can extend the VDE window of operation. The acceleration sensors are used to identify the conditions in which partial-cylinder operation generates increased NVH levels, and correspondingly adjust engine operation to reduce the NVH.

Additionally, the control system can adaptively learn the windows of partial-cylinder operation that reduce or avoid increased NVH conditions. For example, the control system may store the operating conditions of the vehicle and/or engine where partial-cylinder operation was disabled in response to the vehicle acceleration. The current operating conditions may include engine speed, engine load, vehicle speed, engine temperature, ambient temperature, gear ratio, etc. In this way, the partial-cylinder mode may be appropriately selected based on previously determined operating conditions.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted.

Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine of a vehicle, the engine having one or more deactivatable cylinders, comprising:

controlling vehicle operation to increase a vehicle stability in response to a lateral vehicle acceleration; and reactivating or deactivating combustion in a cylinder in response to the lateral vehicle acceleration.

2. The method of claim 1, further comprising reactivating the combustion in a deactivated cylinder in response to a magnitude of the lateral vehicle acceleration at a firing frequency of the engine.

3. The method of claim 2, further comprising filtering the lateral vehicle acceleration to reduce frequencies outside the firing frequency of the engine, where the firing frequency is determined based on engine speed and a number of activated cylinders carrying out combustion.

4. The method of claim 1, wherein controlling vehicle operation includes actuating one or more wheel brake mechanisms in the vehicle.

5. The method of claim 1, wherein reactivating combustion includes injecting fuel into a combustion chamber of a deactivated cylinder, and operating an intake and exhaust valve associated with the cylinder.

6. The method of claim 1, wherein reactivating combustion in a deactivated cylinder in response to the lateral vehicle acceleration includes reactivating combustion when the lateral vehicle acceleration has surpassed a threshold magnitude at a selected frequency.

7. The method of claim 6, further comprising increasing the threshold magnitude of acceleration in response to an indication of rough road conditions.

8. The method of claim 7 where the indication of rough road conditions is based on wheel speed of a plurality of wheels of the vehicle.

9. The method of claim 1 further comprising inhibiting deactivation for a predetermined duration following reactivating combustion.

10. The method of claim 1 wherein reactivating cylinders includes operating an exhaust valve, operating an intake valve, and supplying fuel to the cylinder for combustion.

11. A system for a vehicle including an engine, the engine having one or more deactivatable cylinders, comprising:

a vehicle lateral acceleration sensor coupled to the vehicle;

a wheel speed sensor coupled to a wheel of the vehicle;

a wheel brake mechanism coupled to the wheel of the vehicle; and a control system for adjusting the wheel brake mechanism in response to the vehicle lateral acceleration sensor to improve the stability of the vehicle during traveling conditions of the vehicle, the control system further filtering the vehicle lateral acceleration sensor to pass frequencies around a firing frequency of the engine, and reactivating one or more deactivated cylinders of the engine in response to whether a magnitude of the lateral acceleration at the passed frequencies is greater than a threshold magnitude, the threshold adjusted in response to a rough road indication, the rough road indication based on the wheel speed sensor.

12. The system of claim 11 wherein the control system further includes a band-pass filter configured to pass frequencies around the firing frequency.

13. The system of claim 12 wherein the control system further determines a band of the band-pass filter based on engine speed and a number of activated cylinders.

14. The system of claim 11 wherein the vehicle lateral acceleration sensor is mounted substantially perpendicular to a direction in which the engine is mounted.

15. A system for a vehicle, comprising:

a variable displacement engine configured to deactivate a plurality of cylinders of the engine by disabling fuel injection and/or holding intake and exhaust valves closed for at least a cycle of the engine;

a vehicle lateral acceleration sensor coupled in the vehicle;

a wheel speed sensor coupled to a wheel of the vehicle;

a wheel brake mechanism coupled to the wheel of the vehicle; and a control system for adjusting the wheel brake mechanism in response to the vehicle lateral acceleration sensor to improve the stability of the vehicle during traveling conditions of the vehicle, the control system including a band-pass filter configured to filter the vehicle lateral acceleration sensor to pass frequencies at firing frequency of the engine, the control system further reactivating the plurality of deactivated cylinders of the engine when a magnitude of the lateral acceleration at the passed frequencies is greater than a threshold magnitude, the threshold magnitude adjusted in response to a rough road indication, the rough road indication based on the wheel speed sensor.

* * * * *